US007887060B2

(12) United States Patent
Chiu

(10) Patent No.: US 7,887,060 B2
(45) Date of Patent: Feb. 15, 2011

(54) GAME APPARATUS WHICH COMBINES WITH STEPPING, BALANCING AND JUMPING

(76) Inventor: I-Cheng Chiu, 9F, No. 70, Sec. 5, Nan-King East Rd., Taipei (TW)

( * ) Notice: Subject to any disclaimer, the term of this patent is extended or adjusted under 35 U.S.C. 154(b) by 0 days.

(21) Appl. No.: 12/467,263

(22) Filed: May 16, 2009

(65) Prior Publication Data

US 2010/0289222 A1 Nov. 18, 2010

(51) Int. Cl.
*A63F 9/26* (2006.01)

(52) U.S. Cl. ..... 273/449

(58) Field of Classification Search ..... 273/440, 273/449, 450; 404/35, 41
See application file for complete search history.

(56) References Cited

U.S. PATENT DOCUMENTS 1,490,201 A * 4/1924 Brown ..... 273/444
3,558,133 A * 1/1971 Reiner et al. ..... 273/444
3,761,084 A * 9/1973 Dieckmann ..... 273/444
5,749,555 A * 5/1998 Albrecht ..... 248/346.01
7,261,299 B1 * 8/2007 Chiu ..... 273/440
7,367,565 B2 * 5/2008 Chiu ..... 273/449
7,594,777 B2 * 9/2009 Chiu ..... 404/35

* cited by examiner

*Primary Examiner*—Raleigh W. Chiu
(74) *Attorney, Agent, or Firm*—Pro-Techtor Int'l Services; Ralph Willgohs

(57) ABSTRACT

A game apparatus which combines with stepping, balancing and jumping is formed by assembling a plurality of seats, a level panel and a curved panel. The upper and lower seats can be stacked together to change a height of the seats; whereas, the level panel and the curved panel can serve as bridge plates to connect the seats, so that children can be provided with various games of striding and jumping. Moreover, the seat and panel surfaces of the level panel and the curved panel are provided respectively with a skid-proof block and projections in various stylistic image shapes, so as to assure game safety of the children upon striding or jumping.

6 Claims, 7 Drawing Sheets

GAME APPARATUS WHICH COMBINES WITH STEPPING, BALANCING AND JUMPING

BACKGROUND OF THE INVENTION a) Field of the Invention

The present invention relates to a game apparatus which combines with stepping, balancing and jumping, and more particularly to a game apparatus which is assembled by utilizing a seat and a bridge plate to change into plural playing methods of various paths and heights, thereby developing a sense of balance and a learning ability of a child.

b) Description of the Prior Art

An ordinary conventional game apparatus is a monotonous and crude assembly, which cannot combine with an island and a bridge plate, allowing a child to drive development and learning of sense organs in a gaming process.

SUMMARY OF THE INVENTION

The primary object of the present invention is to provide a game apparatus which combines with stepping, balancing and jumping which combines with plural seats and connecting bridge plates of level panels and curved panels to form all kinds of variations, so that children can be provided with different striding and jumping games and id-proof blocks and projections in a natural totem shape can be even assembled to assure game safety of the children.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

The present invention discloses a game apparatus of all kinds of variations, which is formed by connecting plural seats 10 with bridge plates, such as level panels 20 or curved panels 30.

Figure 1:
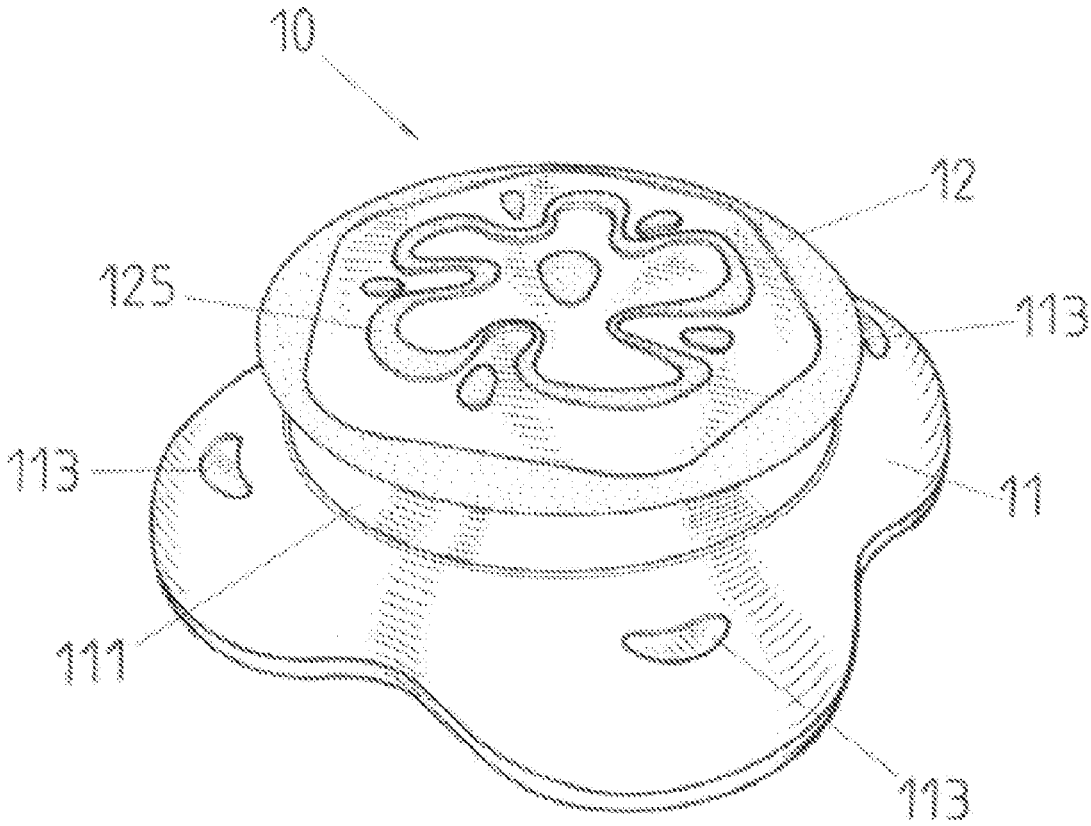
FIG. 1 shows a schematic view of an appearance of a seat of the present invention.
Figure 2:
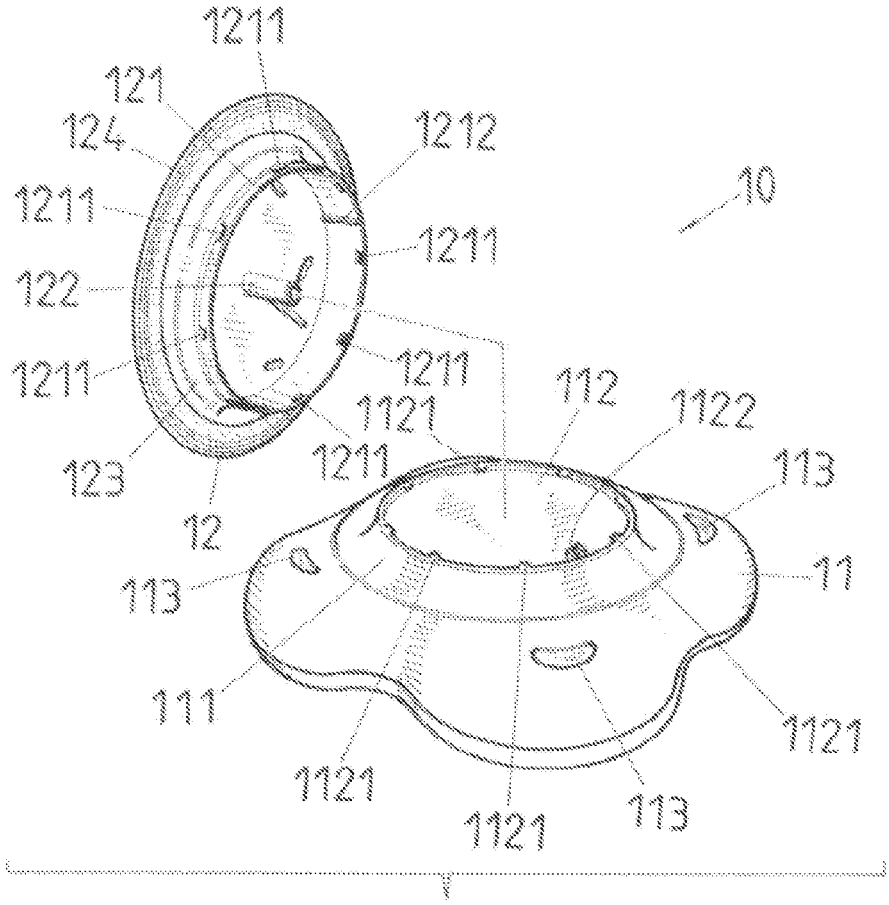
FIG. 2 shows an exploded view of a seat of the present inventions.

Referring to FIG. 1 and FIG. 2, the seat 10 is constituted by a base 11 and a top block 12.

Figure 3:
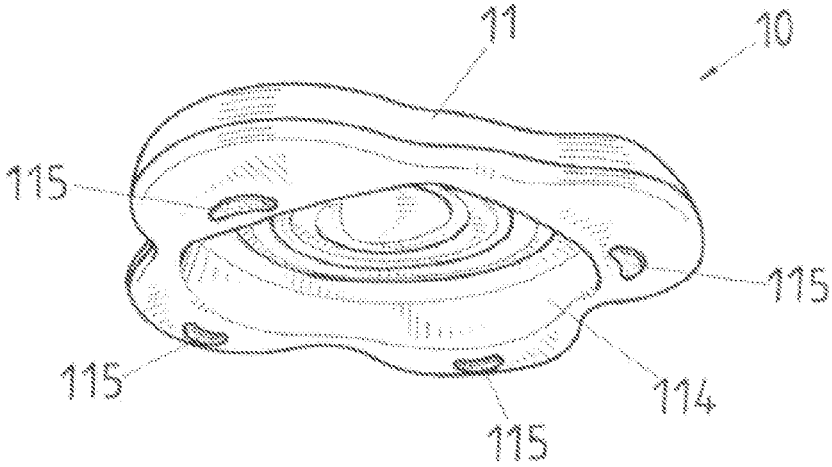
FIG. 3 shows a bottom schematic external view of a seat of the present invention.

Above the base 11 is provided with an annular lock slot 111, an interior side of the lock slot 111 is provided with a circular latch slot 112, a rim of the latch slot 112 is provided with plural hook-shape fixing blocks 1121, between two neighboring fixing blocks 1121 is provided with a positioning slot 1122 formed by two bumps, and peripheries at an exterior side of the lock slot 111 are provided with cavities 113. Referring to FIG. 3, a bottom of the base 11 is provided with a large groove 114, and peripheries at an exterior side of the groove 114 are provided with skid-proof pads 115 which can prevent from skidding to assure game safety of a user.

A bottom of the top block 12 is provided with a collar 121 on which are plural lock holes 1211, and a positioning pillar 1212 is provided between two neighboring lock holes 1211. When the collar 121 is latched into the latch slot 112 of the base 11, the fixing blocks 1121 of the base 11 are locked respectively into the lock holes 1211 of the top block 12 for fixing; whereas, the positioning pillar 1212 of the top block 12 is locked into the positioning slot 1122 of the base 11 for positioning. A top center of the top block 12 is provided with a top pillar 122 which is abutted at a center of the latch slot 112 of the base 11. In addition, an exterior side of the collar 121 is provided with an annular lock slot 123 which forms a locking rail with the lock slot 111 of the base 11, an exterior side of the lock slot 123 is a concavo-convex buffering part 124 which is provided with some elasticity, and a top surface of the top block 12 is protruded with a totem-shape skid-proof block 125 (as shown in FIG. 1).

Figure 4:
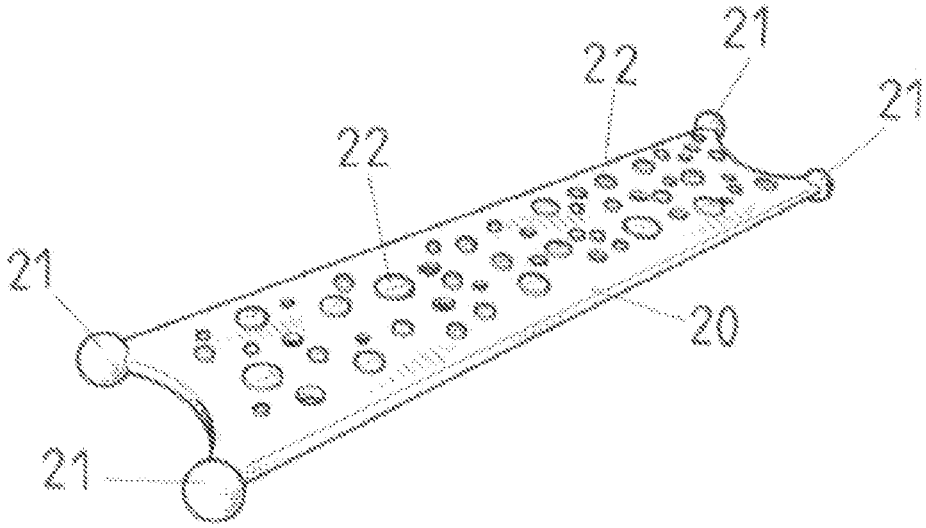
FIG. 4 shows a schematic external view of a level panel of the present invention.
Figure 5:
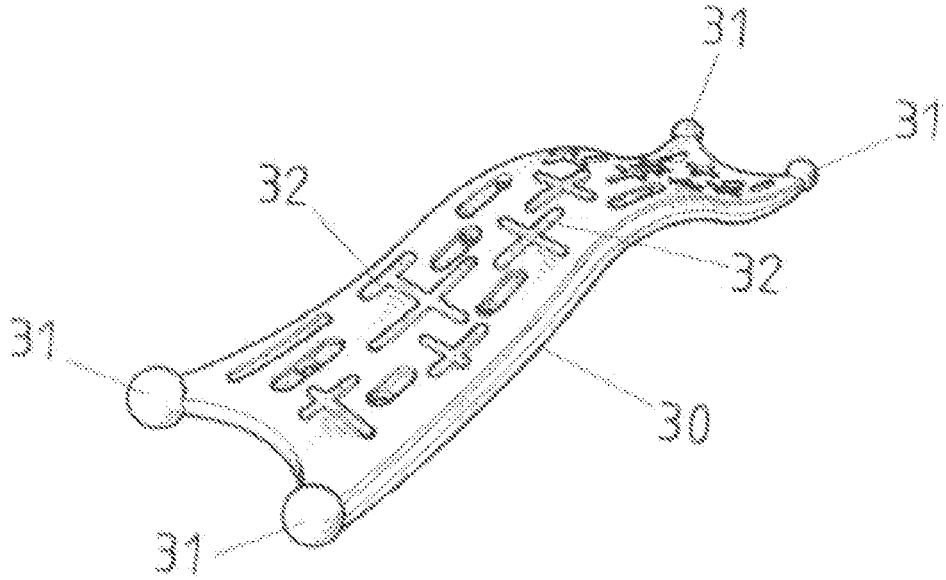
FIG. 5 shows a schematic external view of a curved panel of the present invention.
Figure 6:
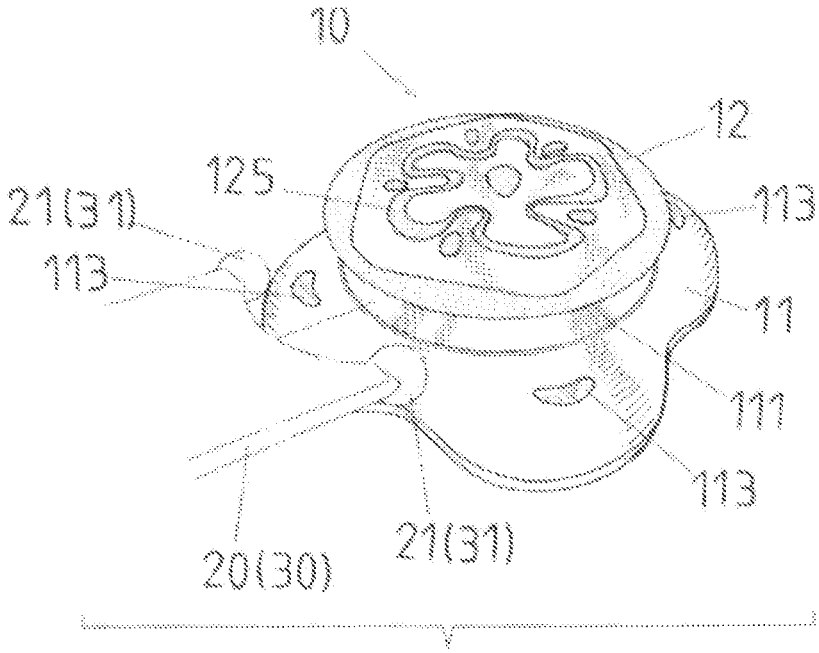
FIG. 6 shows a schematic external view of the present invention before assembling a level panel or a curved panel with a seat.
Figure 7:
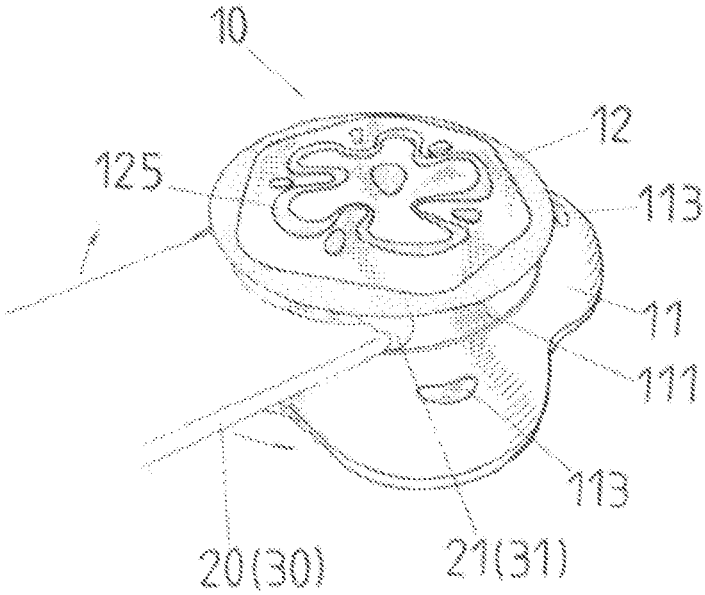
FIG. 7 shows a schematic external view of the present invention after assembling a level panel or a curved panel with a seat.

Referring to FIG. 4 and FIG. 5, two ends of a level panel 20 and a curved panel 30 are provided respectively with two lock balls 21, 31. Referring to FIG. 6 and FIG. 7, the lock balls 21, 31 at one end of the level panel 20 or the curved panel 30 are locked respectively into the locking rail that is formed by the lock slots 111, 123 of the base 11 and the top block 12. The level panel 20 or the curved panel 30 can rotate leftward or rightward freely in the rail with the lock balls 21, 31 as pivots.

Figure 8:
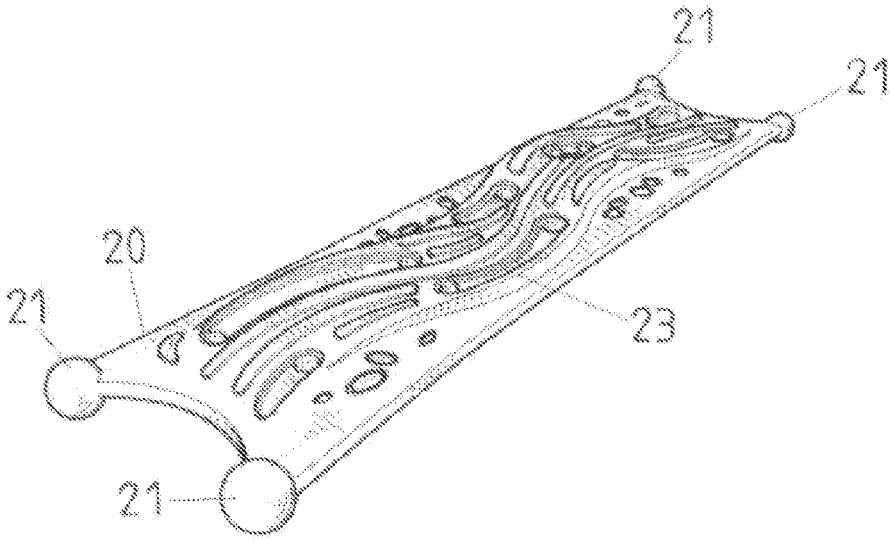
FIG. 8 shows another side schematic external view of a level panel of the present invention.
Figure 9:
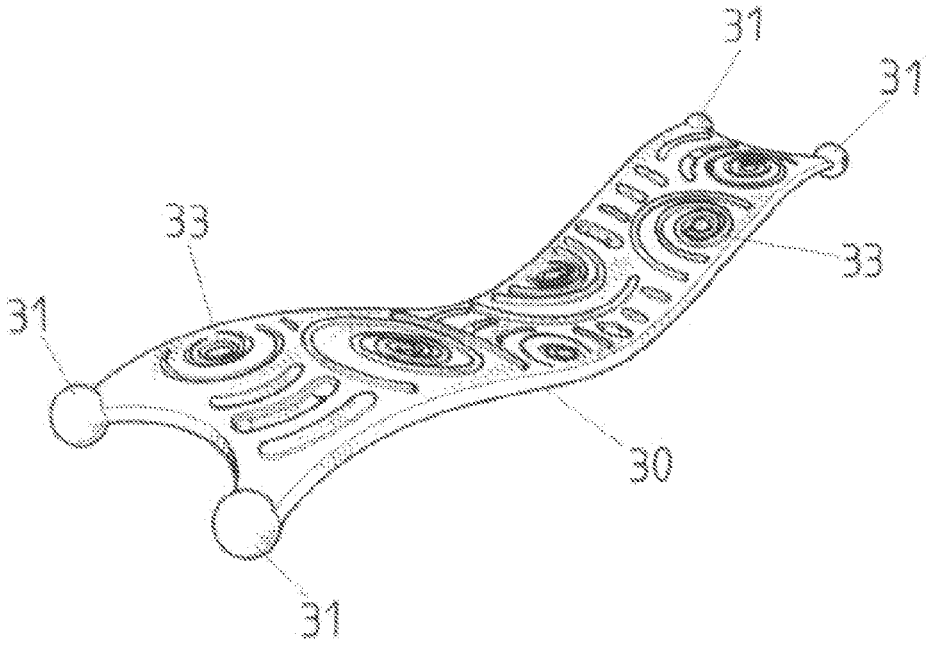
FIG. 9 shows another side schematic eternal view of a curved panel of the present invention.

On the other hand, a panel surface of the level panel 20 or the curved panel 30 is designed with all kinds of projections in a totem-shape. Referring to FIG. 4, a projection 22 on the level panel 20 is a totem of a waterdrop pattern; referring to FIG. 5, a projection 32 on the curved panel 30 is a wavy cross-shape totem; referring to FIG. 8, a projection 23 on a rear surface of the level panel 20 is a water-line totem; and referring to FIG. 9, a projection 33 on a rear surface of the curved panel 30 is a swirl-shape totem.

Figure 10:
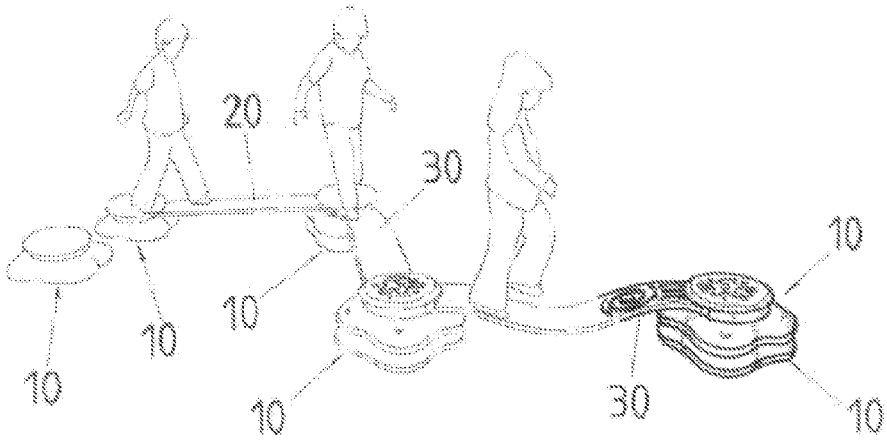
FIG. 10 shows a schematic view of a first embodiment of the present invention.

Referring to FIG. 10, it shows a game apparatus which is arranged in a curve by assembling the plural island-shape seats 10 with the level panels 20 and the curved panels 30, allowing children to step on the island and the bridge plates to promote coordination and a sense of balance to body movement of the children.

Figure 11:
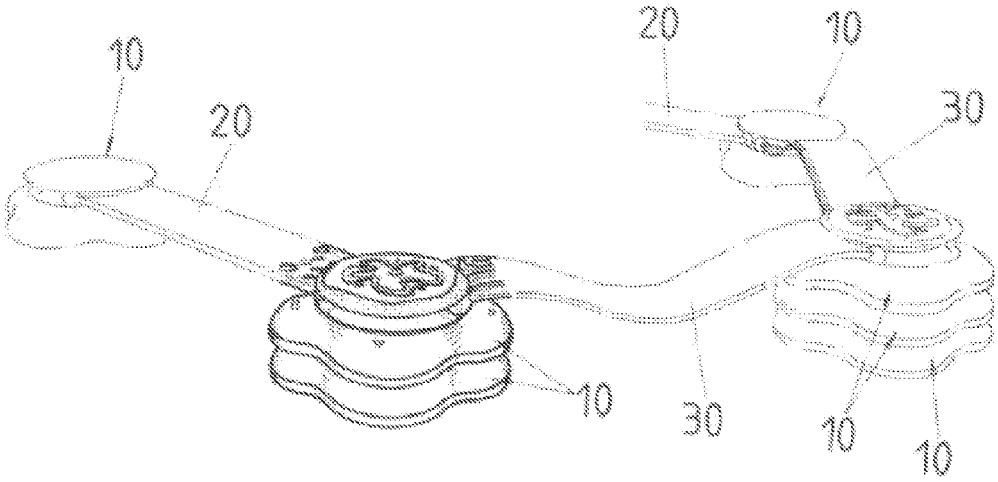
FIG. 11 shows a schematic view of a second embodiment of the present invention.
Figure 12:
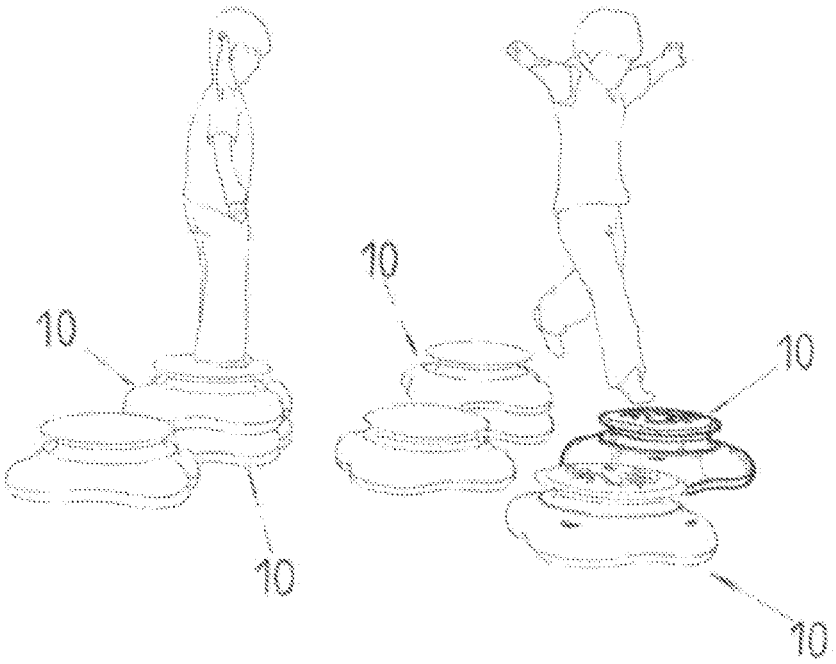
FIG. 12 shows a schematic view of a third embodiment of the present invention.
Figure 13:
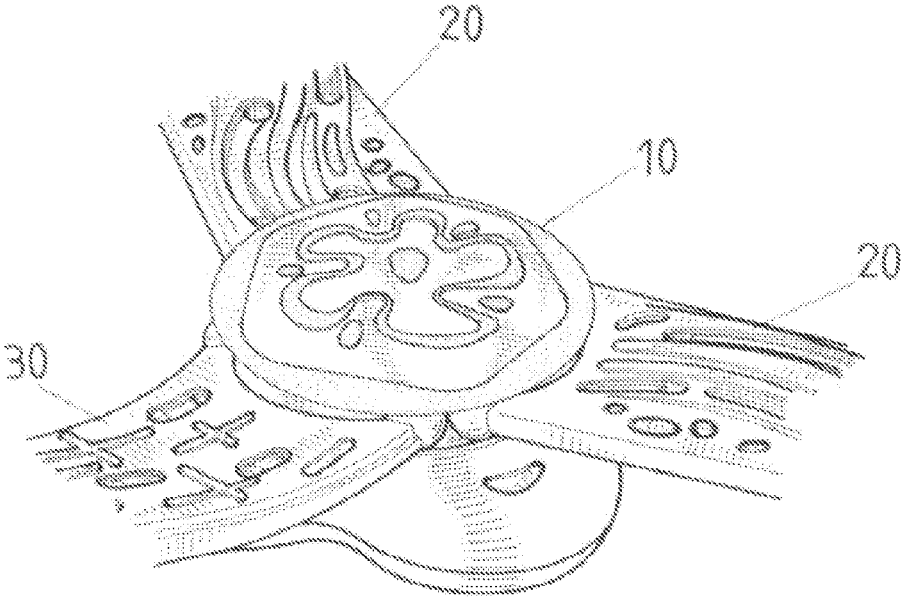
FIG. 13 shows a schematic view of a fourth embodiment of the present invention.

Referring to FIG. 11 the seats 10 can stacked upward in layers to raise up the bridge plates, forming another kind of arrangement; wherein, the upper seat 10 is sheathed on the top block 12 of the lower seat 10 with the groove 114 at the bottom, and the skid-proof pads 115 at the bottom of the upper seat 10 are latched into the cavities 113 on the lower seat 10. Referring to FIG. 12, the plural seats 10 alone are arranged into a jumping game apparatus, and as the lower side of each seat 10 is provided with the skid-proof pads 115, and the upper side is provided with the skid-proof block 125, the game safety of the children can be assured. Referring to FIG. 13, two level panels 20 and one curved panel 30 are locked respectively into the locking rail of the seat 10.

Conclusive from the above, in accordance with the present invention, the game apparatus that is formed by arranging and assembling the seats, the level panels and the curved panels can stack and change the height of the bridge plates, and can even provide the children with the different striding and jumping games, using a combination of the surface totems and the natural elements.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A game apparatus which provides stepping, balancing, and jumping activities, comprising a pluralality of seats, each of which is an assembly of a base and a top block, wherein an upper surface of the base is provided with an annular lock ring, an interior side of the lock ring is provided with a latch opening, a bottom of the base is provided with a recess, peripheries at an outer side of the recess are provided with skid-proof pads, a bottom of the top block is provided with a collar which is latched into the latch opening of the base, and an exterior side of the collar is provided with a locking spline which is formed by the annular lock ring and the lock ring of the base; at least one level panel, two ends of which are provided respectively with two lock balls, with the two lock balls being locked respectively into the symmetric lock rings of the base and the top block of the seat; and at least one curved panel, two ends of which are provided with two lock balls, with the two lock balls being locked respectively into the symmetric lock rings of the base and the top block of the seat; the aforementioned seats being stacked upward and downward, wherein the recess of the upper seat is sheathed on the top block of the lower seat, whereas the level panel and the curved panel are connected to two neighboring seats to form bridge plates, so as to assemble into a game apparatus of many variations.

2. The game apparatus provides stepping, balancing, and jumping activities, according to claim 1, wherein a rim of the latch ring of the base of the seat is provided with a pluralatity of lock blocks and the collar of the top block is provided with a pluralalitv of lock holes for locking and positioning the lock blocks.

3. The game apparatus which provides stepping, balancing, and jumping according to claim 1, wherein a rim of the latch ring of the base of the seat is provided with a positioning slot and the collar of the top block is provided with a positioning spline which is seated into the positioning slot for positioning.

4. The game apparatus which provides stepping, balancing and jumping activities, according to claim 1, wherein peripheries outward of the lock ring of the base are provided with cavities, such that when the seats are stacked upward or downward, the skid-proof pads of the upper seat are latched into the cavities of the lower seat.

5. The game apparatus which provides stepping, balancing, and jumping activities, according to claim 1, wherein a top surface of the top block of the seat is provided with a protruded skid-proof block in various stylistic image shapes.

6. The game apparatus which provides stepping, balancing, and jumping activities, according to claim 1, wherein a panel surface of the level panel is provided with at least one projection in various stylistic image shapes.

* * * * *